US005788159A

United States Patent [19]

Pischek

[11] Patent Number: 5,788,159

[45] Date of Patent: Aug. 4, 1998

[54] METHOD AND APPARATUS FOR APPLYING COMPOSITIONS

[75] Inventor: Stefan Pischek, Mainz, Germany

[73] Assignee: Didier-Werke AG, Wiesbaden, Germany

[21] Appl. No.: 687,026

[22] Filed: Jul. 25, 1996

[30] Foreign Application Priority Data

Jul. 31, 1995 [DE] Germany ..... 195 28 025.3

[51] Int. Cl.[6] ..... B05B 3/00

[52] U.S. Cl. ..... 239/227; 239/236; 239/263.3; 266/281; 266/218; 264/30; 74/128

[58] Field of Search ..... 239/225.1–227, 239/236, 263.3, 264, DIG. 13; 266/281, 218; 264/30; 74/128

[56] References Cited

U.S. PATENT DOCUMENTS

| | | | |
|---|---|---|---|
| 2,029,795 | 2/1936 | Richard | 239/227 |
| 3,833,334 | 9/1974 | Riley | 425/449 |
| 4,272,020 | 6/1981 | Allison | 266/281 |
| 4,494,737 | 1/1985 | Rymaechyk, Jr. et al. | 266/281 |
| 4,930,757 | 6/1990 | Manwell et al. | 266/270 |
| 4,995,596 | 2/1991 | Rothfuss et al. | 266/281 |

FOREIGN PATENT DOCUMENTS 38 33 506 1/1991 Germany .

*Primary Examiner*—Andres Kashnikow
*Assistant Examiner*—Lisa Ann Douglas
*Attorney, Agent, or Firm*—Wenderoth, Lind & Ponack, L.L.P.

[57] ABSTRACT

A circular, surface-coating application of sprayable composition or mortar is achieved through a rotatable spray head with at least one lateral discharge opening. The composition or mortar is distributed as uniformly and over as large a surface area as possible in the vicinity of the spray head. The spray head is moved axially forwards and back in an axial direction through the same distance during conveying of the composition or mortar and is rotated automatically through the same angular distance about the axis.

32 Claims, 3 Drawing Sheets

METHOD AND APPARATUS FOR APPLYING COMPOSITIONS

BACKGROUND OF THE INVENTION

The present invention relates to a method and an apparatus for the circular, surface-coating application of sprayable compositions or mortars from a rotatable spray head with at least one lateral discharge opening, which is connected to a supply line for the composition or the mortar and optionally for a conveying medium, particularly for repairing a nozzle brick of a metallurgical vessel.

Bricks, for instance a nozzle brick, of a metallurgical vessel wear away. They are repaired before being replaced by spraying compositions or mortar onto the worn regions. Apparatus for spraying a repair composition onto a nozzle brick is described in DE 38 33 506 C2. A spray head for applying the repair composition is pushed through the nozzle brick so that composition is applied by the spray head to the worn region in the interior of the vessel. The spray head is axially movable and rotatable about its axis. It is left open as to how the axial displacement and the rotation of the spray head is to be achieved. Since the worn region cannot be seen, a suitable distribution of the repair composition is difficult.

SUMMARY OF THE INVENTION

It is an object of the invention to provide a method and apparatus of the type referred to above in which the composition or the mortar is automatically distributed as uniformly as possible in the vicinity of the spray head.

In accordance with the present invention the above object is achieved in the method of the type referred to above by moving the spray head axially through the same distance forwards and back (a working step) while the composition or the mortar is conveyed in the axial direction and by rotating the spray head about its axis during each working step by the same angular distance (a rotational step). The spray head is moved axially forwards and back in each working step so that the composition is distributed radially over a region which is substantially larger radially than without axial movement. Furthermore, the spray head is necessarily rotated through a predetermined angular distance in each working step, whereby the spray head is rotated through 360° after a plurality of working steps. The composition is thus also uniformly distributed over the peripheral region. Taken together, the composition is thus distributed over a comparatively large circular area on the component, particularly nozzle brick, to be repaired. The working steps can be performed manually or mechanically, for instance pneumatically or electrically. The rotational steps result from positive coupling with axial or lifting movement.

An apparatus for carrying out the method provides that a supply line is fixedly connected to the spray head and is mounted so as to be axially movable and rotatable about an axis in a cylindrical guide housing which is fixable in position with respect to the component to be coated with composition or mortar, and that a drive moves the supply line incrementally axially and in rotation.

BRIEF DESCRIPTION OF THE DRAWINGS

Further advantageous embodiments of the invention will be apparent from the dependent claims and the following description of an exemplary embodiment. In the drawings:

DETAILED DESCRIPTION OF THE INVENTION

Figure 1:
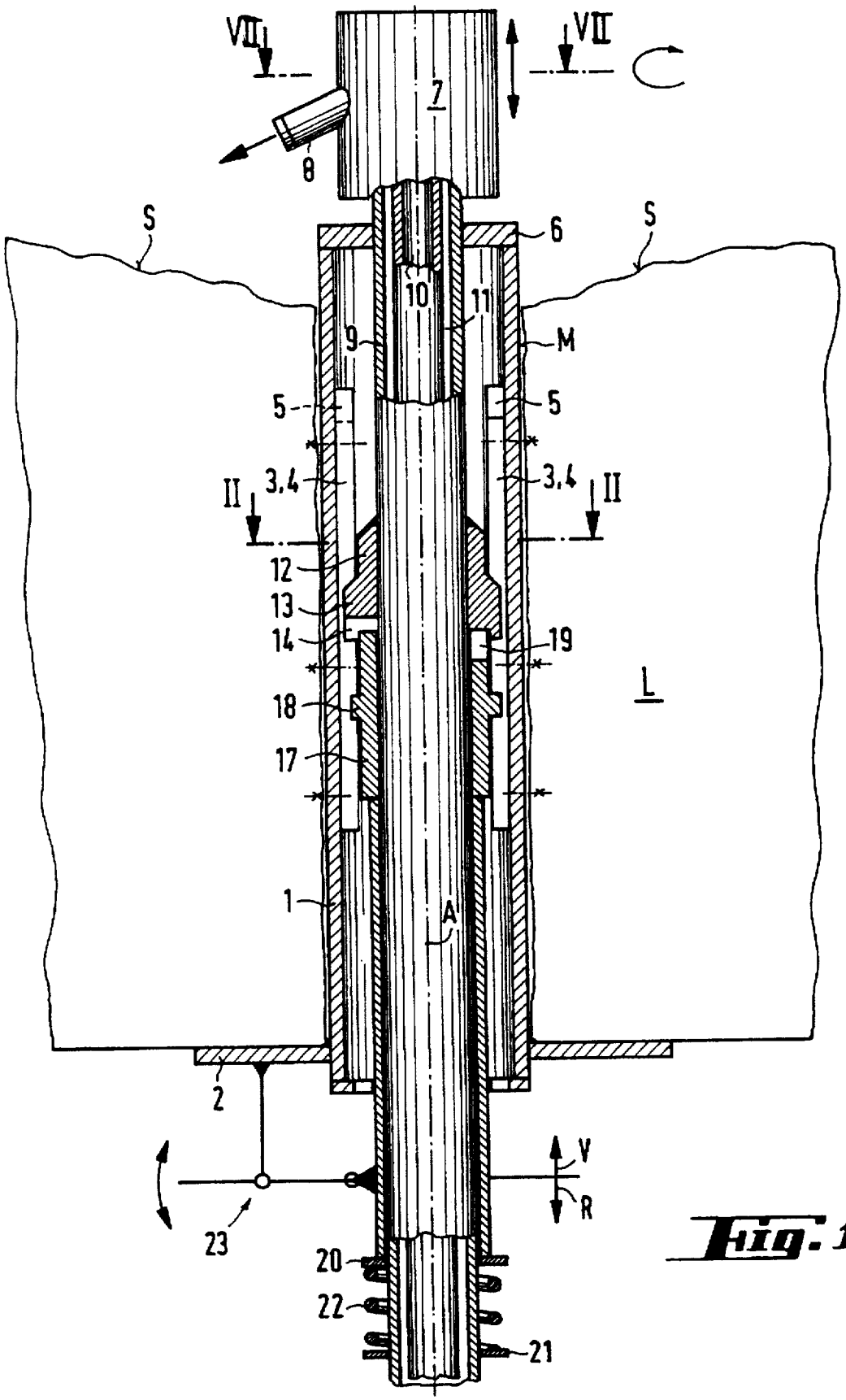
FIG. 1 is a partial sectional view of an apparatus for applying a composition according to the invention, the apparatus being shown inserted into a nozzle brick.

The apparatus of the invention includes a cylindrical guide housing 1 securable by means of a flange 2 thereof to the exterior of a metallurgical vessel so that housing 1 is fixed opposite to a nozzle brick L. The cylindrical guide housing 1 extends in the installed state into a passage or hole M of the nozzle brick L (see FIG. 1). If the hole M is conical, the cylindrical guide housing 1 can be provided with a correspondingly conical shell which ensures as close as possible of an engagement of the cylindrical guide housing 1 in the hole M. A worn side S of the nozzle brick L, which is to be coated with composition or mortar, is situated within the metallurgical vessel.

Connected to the internal periphery of the cylindrical guide housing 1 are a plurality of guide bars 3 which extend parallel to axis A of housing 1. Between the guide bars 3 are guide grooves 4 extending parallel to axis A. Each guide bar 3 is provided at its upper end with a bevel or beveled end 5. The upper ends of the guide bars 3 terminate before an upper closure 6 of the cylindrical guide housing 1. Eight guide bars 3 are uniformly distributed or spaced around the inner periphery of the cylindrical guide housing 1 (see FIG. 2). It is also possible to provide an even number of guide bars 3 greater than eight.

A supply line is guided to be axially movable along axis A and rotatable about axis A within the cylindrical guide housing 1. Rigidly secured to the supply line outside the cylindrical guide housing 1 is a spray head 7 having at least one spray nozzle 8 directed onto the side S of the nozzle brick L. The supply line comprises an outer tube 9 and an inner tube 10 coaxial therewith. The composition may be supplied to the spray head 7 through the inner pipe 10. A conveying medium, for instance compressed air, which improves the spraying of the composition, may be supplied to the spray head 7 through a space 11 between the outer tube 9 and the inner tube 10.

Rigidly secured to the outer tube 9 is a rotary head 12 which has radial dogs 13 which are provided for engagement in the guide grooves 4. The rotary head 12 has four dogs 13 in the exemplary case. Formed on an axial engagement surface of the rotary head 12, particularly on dogs 13, are teeth 14 each having a longer flank 15 and a shorter flank 16. The teeth 14 define a rear or outer end surface of the rotary head 12.

Figure 2:
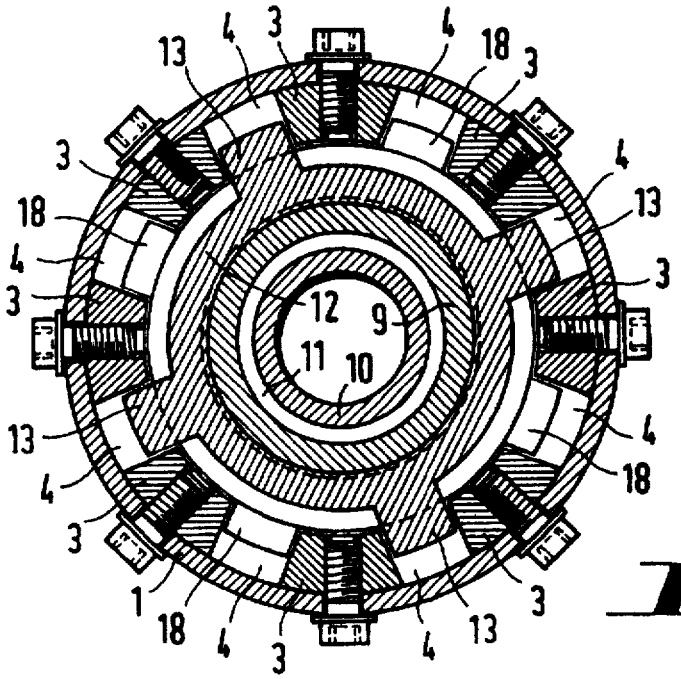
FIG. 2 is a sectional view taken on line II—II in FIG. 1.

Mounted on the outer pipe 9 so as to be axially movable and not rotationally fixed is a crown plunger 17 having projections or noses 18 which engage in the guide grooves 4. The crown plunger 17 is thus rotationally fixable and axially movable with respect to the cylindrical guide housing 1. On a front or inner end surface, which is directed towards the rear end surface of the rotary head 12, that is to say teeth 14, the crown plunger 17 has eight teeth 19 which are uniformly distributed around its periphery. Only four of teeth 19 are seen in FIG. 2 because the teeth 19 therebetween are concealed by the dogs 13 or the teeth 14 on the rotary head 12.

Arranged outside the cylindrical guide housing 1, between an outer or rear end surface 20 of the crown plunger 17 and an abutment ring 21 secured to the outer pipe 9, is a compression spring 22. A lifting mechanism 23, which together with the device described above constitutes a lifting and rotary drive for the spray head 7, engages the crown plunger 17 outside the cylindrical guide housing 1. The lifting mechanism 23 may be actuated manually or pneumatically or electromechanically.

Figure 3:
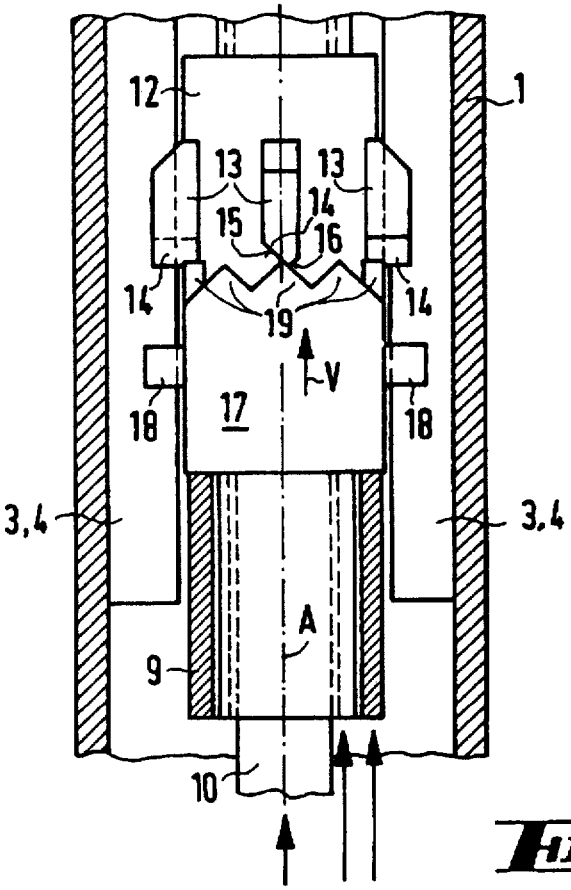
FIG. 3 is a partial sectional view of the apparatus during an advancing movement.

The mode of operation of the above apparatus is as follows. The lifting mechanism 23 is actuated while composition or mortar is conveyed through the inner pipe 10 and compressed air is conveyed through the space 11. If the lifting mechanism 23 is moved in one direction, starting from the position illustrated in FIG. 1, then the crown plunger 17 moves in the direction of an advancing stroke V. Crown plunger 17 pushes with half of its teeth 19 against the tooth flanks 15 of the teeth 14 of the dogs 13 on the rotary head 12. The teeth 19 and the tooth flanks 15 initially can not yet slide against one another because, not only is the crown plunger 17 guided so as to be non-rotatable but axially movable by its noses 18, but dogs 13 of rotary head 12 also are guided in guide grooves 4 so as to be non-rotatable and axially movable (see FIG. 3). The spray head 7 thus is moved upwardly, i.e. inwardly.

Figure 4:
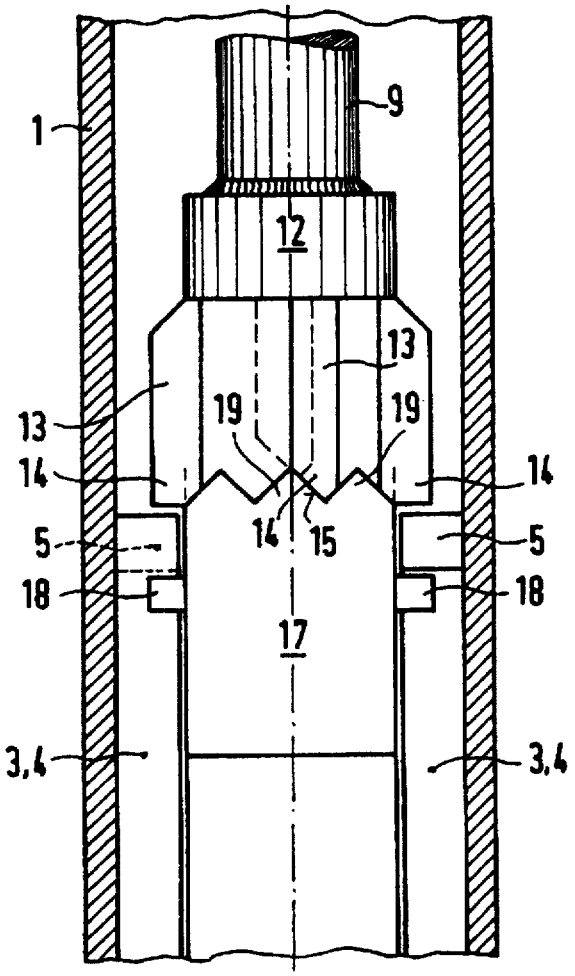
FIG. 4 is a partial sectional view of the apparatus after a first rotational movement.

Towards the end of the advancing stroke V, the dogs 13 move out of the guide grooves 4 because they move beyond the guide bars 3 (see FIG. 4). Under the action of the prestressed compression spring 22, the flanks 16 of the teeth 14 of the rotary head 12 now move onto the root of the teeth 19 on the crown plunger 17 (see FIG. 4), whereby the rotary head 12 rotates slightly in a first rotational movement until the dogs 13 no longer can come between the same guide bars 3 during further movement. The compression spring 22 partially relaxes, but however still remains stressed. The outer pipe 9 and the inner pipe 10 and the spray head 7 also rotate corresponding to the rotation of the rotary head 12.

Figure 5:
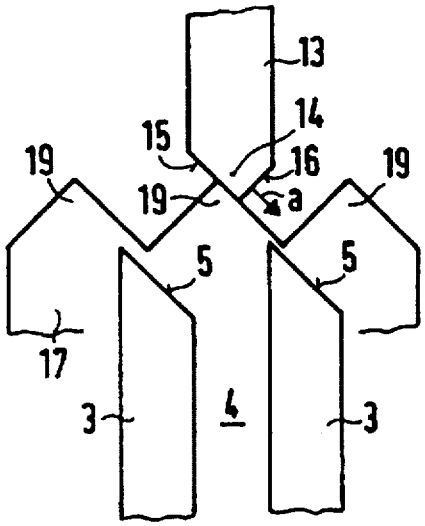
FIG. 5 is a schematic view corresponding to FIG. 4.

FIG. 5 shows the described steps schematically to make them clear. The flank 15 of a tooth 14 on a dog 13 engages a tooth 19 on the crown plunger 17. Since the dog 13 is free from the guide bars 3, its tooth 14 can slip under the action of the compression spring 22 onto the root between the adjacent teeth 19 on the crown plunger 17. This is indicated by arrow a in FIG. 5. The aforementioned first rotational movement thus occurs. The tip of the tooth 14 is then positioned above the bevel 5 of the next guide bar 3. The tooth 14 thus can no longer slip into that groove 4 from which the dog 13 was moved during the advancing stroke V.

Figure 6:
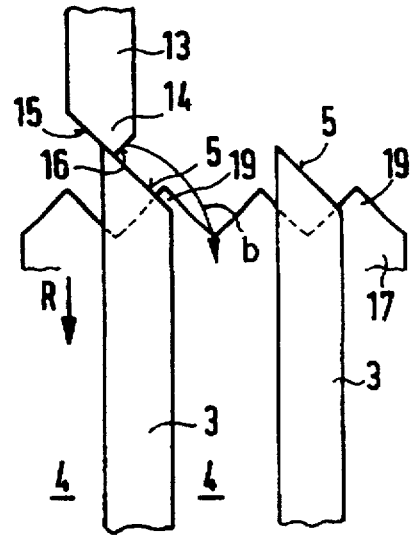
FIG. 6 is a schematic view of the apparatus during a second rotational movement.

The lifting mechanism 23 is then subsequently moved in the other direction (return stroke R). The flanks 15 of the teeth 14 on the rotary head 12 then move onto the bevels 5 on the guide bars 3 (see FIG. 6) and move into the respective adjacent guide groove 4, which is indicated by the arrow b in FIG. 6. A second rotational movement thus occurs which is in the same direction as the first rotational movement. The first rotational movement and the second rotational movement together constitute a rotational step which is 45° in the exemplary case. The spray head 7 thus has rotated further through 45° and then moves in the course of the return stroke R of the crown plunger 17 back into its axial starting position. In each working step (advancing stroke with return stroke) the spray head 7 thus rotates through the same rotational step, 45° in the exemplary case. The side S thus is covered circularly uniformly with the composition discharging from the spray nozzle 8. During the return stroke R the compression spring 22 recovers its full prestressing. The spring stroke is dependent on the tooth height and the bevels on the guide bars 3.

Figure 7:
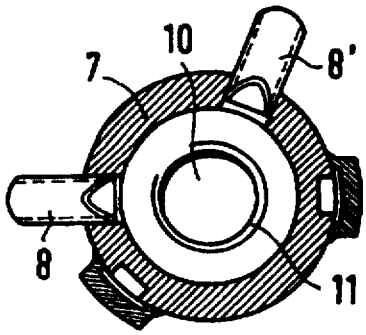
FIG. 7 is a sectional view of a spray head of the apparatus taken on line VII—VII in FIG. 1.

The spray head 7 has a second spray nozzle 8' in FIG. 7. This is so offset on the periphery of the spray head 7 that it is situated between the rotary step positions, 45° in the exemplary case, of the spray nozzle 8. The spray nozzle 8 thus is offset with respect to the spray nozzle 8' by one or more times 45° plus 22.5°, an offset of 112.5° being selected in the exemplary case (see FIG. 7). The result of this is that the spray nozzle 8' covers peripheral regions which are not covered directly by the spray nozzle 8 during its rotational steps. This improves the uniform distribution of the composition.

In order to achieve a yet more thorough distribution of the composition, even when using only one spray nozzle 8, the rotational steps may be made smaller. For this purpose, correspondingly more guide bars 3 and teeth 14 are then provided on the rotary head 12. The number of the teeth 14 corresponds in each case to half the number of guide bars 3.

I claim:

1. An apparatus for spraying a material onto a component, said apparatus comprising:

a guide housing fixable in position with regard to the component to be sprayed;

a supply line mounted in said guide housing for movement in directions axially of an axis thereof and rotatably about said axis;

a spray head mounted on said supply line for movement therewith in said directions; and a drive structure including respective components operably coupled to said supply line and to said guide housing and cooperating to move said supply line incrementally in said directions.

2. An apparatus as claimed in claim 1, wherein said supply line comprises a pipe operable to supply material to be sprayed to said spray head.

3. An apparatus as claimed in claim 1, wherein said supply line comprises inner and outer pipes positioned concentrically of each other and spaced radially of each other.

4. An apparatus as claimed in claim 1, wherein said guide housing has a structure enabling it to be inserted into the component.

5. An apparatus as claimed in claim 4, wherein said guide housing is cylindrical.

6. An apparatus as claimed in claim 1, wherein said drive structure includes a lifting mechanism operable to move said supply line in said axial direction relative to said cylindrical guide housing.

7. An apparatus as claimed in claim 6, wherein said guide housing has fixed to an interior thereof axially extending guide bars.

8. An apparatus as claimed in claim 7, wherein said guide bars are spaced circumferentially of said guide housing, thus defining axially extending guide grooves.

9. An apparatus as claimed in claim 8, further comprising a rotary head fixed to an exterior of said supply line, said rotary head having outwardly extending dogs that fit within said grooves in a first axial position of said supply line relative to said guide housing, thereby preventing rotation of said supply line relative to said guide housing, said dogs being movable out of said grooves in a second axial position of said supply line relative to said guide housing, thereby enabling rotation of said supply line relative to said guide housing.

10. An apparatus as claimed in claim 9, further comprising a plunger member mounted about said supply line and urged axially thereof by a spring.

11. An apparatus as claimed in claim 10, wherein said plunger member has outwardly extending noses that fit within said grooves, such that said plunger member is movable axially relative to said guide housing and is fixed rotatably relative thereto.

12. An apparatus as claimed in claim 11, wherein adjacent axial ends of said rotary head and said plunger member have respective teeth.

13. An apparatus as claimed in claim 12, wherein said lifting mechanism is operable to move said supply line and said rotary head in an advancing stroke in said axial direction from said first axial position thereof to said second axial position thereof, whereat said spring is operable to urge flank surfaces of said teeth of said plunger member and flank surfaces of said teeth of said rotary head against each other and thereby rotate said rotary head and said supply line incrementally by a first rotary movement relative to said guide housing and said plunger member.

14. An apparatus as claimed in claim 13, wherein said first rotary movement is through an angle defined by the inclination and depth of said flank surfaces.

15. An apparatus as claimed in claim 13, wherein said guide bars have beveled end surfaces, and said lifting mechanism is operable to move said supply line in a return stroke opposite to said advancing stroke from said second axial position thereof toward said first axial position thereof, during which said flank surfaces of said rotary head contact and move along said beveled end surfaces and thereby rotate said rotary head and said supply line incrementally by a second rotary movement relative to said guide housing and said plunger member, said first and second rotary movements together constituting a rotational step of said spray head.

16. An apparatus as claimed in claim 15, comprising a plurality of said guide bars and a plurality of said teeth on said rotary head to enable plural said advancing and return strokes to cause rotary movement of said rotary head through 360° relative to said guide housing.

17. An apparatus as claimed in claim 16, comprising eight said guide bars and four said teeth on said rotary head.

18. An apparatus as claimed in claim 15, wherein said spray head has at least two spray nozzles offset from each other in said rotary direction by an angle different from an angle of said rotational step or multiples thereof.

19. An apparatus as claimed in claim 12, wherein said teeth of said rotary head are on said dogs thereof.

20. A method for spraying a material onto a component, said method comprising:

conveying said material through a supply line to a spray head connected thereto, and directing said material from said spray head onto said component;

during said conveying and directing moving said spray head in a plurality of working steps, each comprising moving said spray head back and forth in an axial direction along an axis through advancing and return strokes of the same distance; and during each said working step, performing a respective rotational step by rotating said spray head about said axis through the same angular distance.

21. A method as claimed in claim 20, wherein said component is a nozzle brick of a metallurgical vessel, and said material comprises a repair composition.

22. A method as claimed in claim 21, wherein said material comprises mortar.

23. A method as claimed in claim 20, wherein said spray head is rotated through an angle of 45° during each said rotational step.

24. A method as claimed in claim 20, wherein said spray head is rotated during each said advancing stroke and each said return stroke.

25. A method as claimed in claim 20, comprising positioning a guide housing in said component, and positioning said supply line to extend through said guide housing.

26. A method as claimed in claim 25, wherein said positioning said supply line comprises locating outwardly extending dogs of a rotary head fixed to the exterior of said supply pipe within axial grooves defined between axially extending guide bars spaced around the interior of said guide housing in a first axial position of said supply line relative to said guide housing.

27. A method as claimed in claim 26, comprising moving said supply line to a second axial position thereof relative to said guide housing, whereat said dogs are located out of said grooves.

28. A method as claimed in claim 27, wherein said rotary head has teeth directed toward teeth on a plunger member mounted about said supply line and urged axially thereof by a spring, said plunger member having outwardly extending noses that fit within said grooves, and said advancing stroke comprising moving said supply line from said first axial position to said second axial position, thereby causing said spring to urge flank surfaces of said teeth of said plunger member and flank surfaces of said teeth of said rotary head against each other and thereby rotate said rotary head and said supply line incrementally by a first rotary movement relative to said guide housing and said plunger member.

29. A method as claimed in claim 28, wherein said first rotary movement is through an angle defined by the inclination and depth of said flank surfaces.

30. A claim as claimed in claim 28, wherein said guide bars have beveled end surfaces, and said return stroke comprises moving said supply line from said second axial position toward said first axial position thereof, during which said flank surfaces of said rotary head contact and move along said beveled end surfaces and thereby rotate said rotary head and said supply line incrementally by a second rotary movement relative to said guide housing and said plunger member, said first and second rotary movements together constituting a respective said rotational step of said spray head.

31. A method as claimed in claim 20, comprising directing said material through at least two spray nozzles of said spray head offset from each other by an angle different from said rotational step or multiples thereof.

32. A method as claimed in claim 20, comprising conducting said rotating in response to said working steps due to cooperation between respective components operably coupled to said supply line and to said guide housing.

* * * * *